United States Patent [19]

Woodside

[11] Patent Number: 4,763,232

[45] Date of Patent: Aug. 9, 1988

[54] FESTOON LIGHTING

[76] Inventor: Eric Woodside, 25 Dovedale Road, Offerton, Stockport, England

[21] Appl. No.: 64,018

[22] Filed: Jun. 19, 1987

[30] Foreign Application Priority Data

Jun. 20, 1986 [GB] United Kingdom ..... 8615087

[51] Int. Cl.[4] ..... F21V 21/00

[52] U.S. Cl. ..... 362/249; 362/391; 362/252

[58] Field of Search ..... 362/249, 352, 391, 404, 362/407, 84, 145, 147, 184, 190, 227, 209; 339/99

[56] References Cited

U.S. PATENT DOCUMENTS

| | | | |
|---|---|---|---|
| 2,253,164 | 2/1939 | Benander | 362/391 |
| 2,692,374 | 10/1954 | Carson | 362/391 |
| 3,118,618 | 1/1964 | Holbrook | 362/249 |
| 3,189,310 | 6/1965 | Trueson | 362/249 |
| 3,258,239 | 1/1966 | Green | 362/407 |
| 4,057,718 | 11/1977 | Svensson | 362/391 |
| 4,491,902 | 1/1985 | Cangelosi | 362/249 |
| 4,667,276 | 5/1987 | Cheng | 362/252 |

FOREIGN PATENT DOCUMENTS

| | | | |
|---|---|---|---|
| 716506 | 10/1954 | United Kingdom | 123/249 |

*Primary Examiner*—Raymond A. Nelli

*Attorney, Agent, or Firm*—Oblon, Fisher, Spivak, McClelland & Maier

[57] ABSTRACT

There is disclosed festoon lighting comprising a cable having spaced lamp holders thereon. Each lamp holder comprises parts which lock together by application of axial pressure to cause pins to penetrate the cores of the cable which is located between the parts.

7 Claims, 2 Drawing Sheets

FESTOON LIGHTING

BACKGROUND TO THE INVENTION

This invention concerns festoon lighting of the kind (hereinafter termed of the kind referred to) comprising a length of electric cable incorporating at least two separate cores and a plurality of lamp holder fittings connected with the cable at spaced intervals therealong.

Festoon lighting of the kind referred to is widely used for the decoration of streets and other public places, particularly, though by no means exclusively, at seaside or other holiday resorts.

Known types of festoon lighting of the kind referred to include ones wherein the lamp holder fittings are moulded onto the cable and others wherein the lamp holder fittings incorporate pins which penetrate the cores when clamped onto the cable.

It is an object of the present invention to provide festoon lighting of this latter type which is particularly simple to manufacture and assemble.

BRIEF DISCLOSURE OF THE INVENTION

According to the present invention there is provided festoon lighting of the kind referred to wherein each said lamp holder fitting comprises a lamp holder base having pins projecting therefrom which penetrate the cores of the electric cable and means clamping the lamp holder base to the cable comprising a cylindrical shroud extending from the lamp holder base on one side of the cable and a cap overlying the lamp holder base on the other side of the cable, said shroud and said cap being locked through having been pressed together in an axial direction.

A securing ring may be provided to snap over lugs depending from the cap to prevent accidental separation of the cap and shroud.

The lamp holder may be adapted to receive either bulbs having a screw cap or bulbs having a bayonet cap.

BRIEF DESCRIPTION OF THE DRAWINGS

The invention will be further apparent from the following description with reference to the figures of the accompanying drawings which show, by way of example only, one form of festoon lighting embodying same.

Of the drawings.

DETAILED DESCRIPTION OF THE PREFERRED EMBODIMENTS

Figure 1:
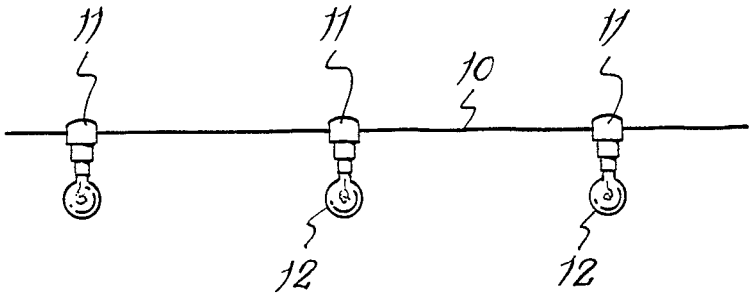
FIG. 1 shows a length of festoon lighting.

Referring now to the drawings it will be seen that the festoon lighting comprises, in known manner, a length of electric cable 10 generally having two cores and a plurality of lamp holder fittings 11 carrying lamp bulbs 12 connected with the cable 10 at spaced intervals therealong.

Each of the lamp holder fittings 11 includes a lamp holder base 14 of insulating material.

Pins 16 protrude from the rear face of the portion 14 into a channel 17 in which the cable 10 lays and penetrate the cores 10*a* and 10*b* of the cable 10 to power bulb supply spring-loaded contacts 18 on the opposite face of the portion 14.

Portion 14 is clamped against the cable 10 by the the interlocking engagement of a cylindrical shroud 20 and a cap 21 which overlies portion 14 on the opposite side of cable 10 from the shroud 20.

The shroud 20 has an external annular detent means 22 engageable with cooperating internal detent means 23 on lugs 24 depending from the cap 21, so that the cap 21 and shroud 20 may be interlocked with a snap action simply by pressing them together in an axial direction.

A securing ring 25 is provided which surrounds the shroud 20 to overlie the lugs 24 to hold them inwardly to prevent accidental separation of the cap 21 from shroud 20.

Figure 2:
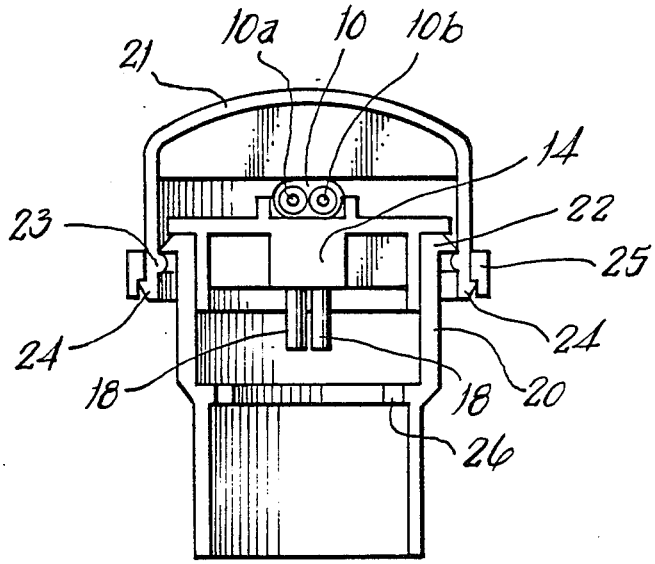
FIG. 2 shows a cross-section through a lamp holder fitting for receiving a bulb with a bayonet cap in position on the electric cable.
Figure 4:
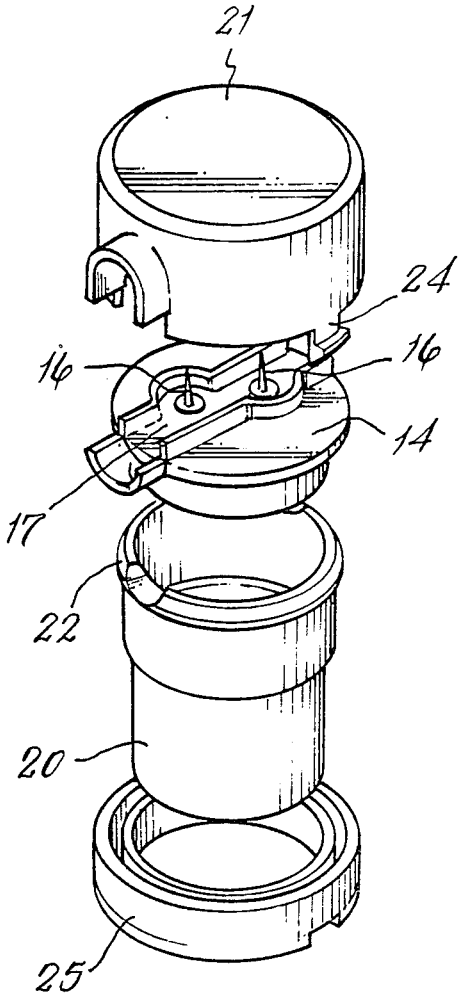
FIG. 4 shows an exploded perspective view of a lamp holder fitting similar to that of FIG. 2 but modified for receiving a bulb having a screw cap.

The contacts 18 may be equi-spaced from the centre of the base 14 on a diameter thereof (FIGS. 2 and 4) for supplying current to a bulb having a bayonet cap, the interior surface of the shroud 20 being provided with moulded slot formations 26 to receive the pins of the bayonet cap.

Figure 3:
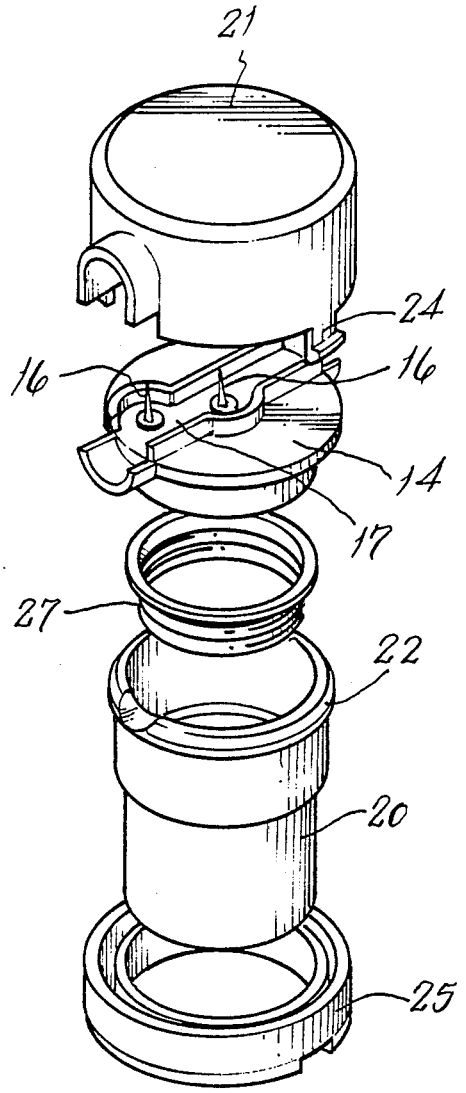
FIG. 3 shows an exploded perspective view of the lamp holder fitting of FIG. 2.

Alternatively (FIG. 3) one contact may be central and the other laterally offset to engage a threaded metal ring 27 located within shroud 20, all for receiving a bulb having a screw cap.

It will be appreciated that it is not intended to limit the invention to the above example only, many variations, such as might readily occur to one skilled in the art, being possible, without departing from the scope thereof as defined by the appended claims.

I claim:

1. Festoon lighting of the kind referred to wherein each lamp holder fitting comprises a lamp holder base having pins projecting therefrom which penetrate the cores of the electric cable, a cylindrical shroud extending from the lamp holder base on one side of the cable and a cap overlying the lamp holder base on the other side of the cable, said shroud and said cap being interengageable with one another when pressed together in an axial direction to clamp the cable therebetween and there being positive locking means having a securing ring adapted to snap over lugs depending from the cap to prevent accidental separation of the cap and the shroud.

2. Festoon lighting according to claim 1 wherein said pins extend through the lamp holder base to connect with spring loaded contacts which carry current to a light bulb fitted into the holder.

3. Festoon lighting according to claim 2 wherein said contacts are equi-spaced from the center of the lamp holder base on a diameter thereof for supplying current to a bulb having a bayonet cap.

4. Festoon lighting according to claim 3 wherein the inner surface of said shroud is moulded with slot formations to receive the pins of the bayonet cap of the bulb.

5. Festoon lighting according to claim 2 wherein one of said contacts is in the center of said light holder base and the other at the side thereof to engage a screw threaded metal ring located within the shroud to receive a bulb having a screw cap.

6. Festoon lighting according to claim 1 wherein said securing ring has apertures to receive said lugs.

7. A lamp holder fitting adapted to be connected with cable to form festoon lighting according to any preceding claim.

* * * * *